US005711027A

United States Patent [19]

Katz et al.

[11] Patent Number: 5,711,027

[45] Date of Patent: Jan. 27, 1998

[54] HAND AND FINGER SHIELD

[76] Inventors: Robert C. Katz, 27 Stacy Dr., Westhampton Beach, N.Y. 11978; William T. Wilkinson, Sunset Farm, 69 Sunset Dr., Salem, N.J. 08079

[21] Appl. No.: 664,933

[22] Filed: May 1, 1996

[51] Int. Cl.[6] ..... A41D 19/00

[52] U.S. Cl. ..... 2/21; 2/20; 2/161.6; 2/159; 15/227; 15/236.01; 15/236.08

[58] Field of Search ..... 2/16, 17, 20, 21, 2/159, 158, 160, 161.5, 161.6, 161.1, 161.2, 161.3, 161.4, 161.7, 161.8, 162, 163, 164, 165, 166, 167, 168; 15/227, 236.01, 236.08

[56] References Cited

U.S. PATENT DOCUMENTS

| | | | |
|---|---|---|---|
| D. 142,806 | 11/1945 | Zimmerman . | |
| D. 351,257 | 10/1994 | Roberts . | |
| 683,869 | 10/1901 | Weichert . | |
| 1,061,014 | 5/1913 | Sawyer | 2/20 |
| 1,554,510 | 9/1925 | Kirby | 15/227 |
| 1,642,311 | 9/1927 | Richardson | 2/163 |
| 1,955,989 | 4/1934 | Uhri | 15/227 |
| 2,322,710 | 6/1943 | Eisendrath . | |
| 2,501,571 | 3/1950 | Liedtke | 2/161.6 |
| 4,507,804 | 4/1985 | Consigny | 2/163 |
| 4,546,495 | 10/1985 | Castillo . | |
| 4,651,350 | 3/1987 | Dawiedczyk . | |
| 4,864,660 | 9/1989 | Sawyer . | |
| 5,234,142 | 8/1993 | Loewen et al. | 2/21 |

*Primary Examiner*—Jeanette E. Chapman
*Attorney, Agent, or Firm*—Connolly & Hutz

[57] ABSTRACT

A hand and finger shield includes a front wall and a rear wall spaced therefrom between which the fingers of a hand may be inserted. The front and rear wall are interconnected by a bottom wall. At least one intermediate wall extends upwardly from the bottom wall and is joined to the front and rear walls so that fingers may be placed on each side of the intermediate wall. This arrangement creates a shield which protects the user's fingers when for example, holding a food item which is being sliced or cut. The shield may also have side walls extending inwardly from the front wall to function as a scoop, scraper, or dispenser of cooking ingredients.

17 Claims, 3 Drawing Sheets

HAND AND FINGER SHIELD

BACKGROUND OF THE INVENTION

Within the past ten to fifteen years the popularity of home cooking and culinary arts has grown to immeasurable proportions from an enjoyable past time to a dedicated duty enhancing the standard of living. The prominence of personalities such as Julia Childs and James Beard has changed from what was once the droll environs for the mother of the family to become blossomed not only for an enjoyable recreation but also an area of artistic development and creativity. It has become imperative to protect the novice as well as the accomplished professional from the dangers that are derived from such activities.

The cutting with blades and knives has become a widespread occupation as well as pastime throughout the world. The common problem encountered by people handling cutting instruments is the danger of the user being cut particularly on the fingers or hands including serious complications such as dismemberment. A further serious problem is the transmission and communication of disease as a result of the cutting activity. The handling of food particularly where blood may be involved from the user being cut, has resulted in the possibility of transmission of foreign and or communicable diseases. This has become a major public health concern with regard to cut-related injuries among food handlers.

Various attempts have been made to provide a shield or other protective device for a user who is handling a knife or other cutting instrument. Generally, such forms of protective devices have been as gloves or as shields which do not however adequately protect the fingers.

SUMMARY OF THE INVENTION

An object of this invention is to provide a hand and finger shield which would fill the great need for a convenient, economic and effective device to shield the hand and fingers while permitting a cutting and chopping operation with sharp instruments such as knives and similar tools.

A further object of this invention is to provide such a device which would be particularly useful for kitchen, domestic or commercial purposes.

In accordance with this invention the hand and finger shield includes front and rear walls spaced from each other and interconnected by a bottom wall so that the fingers may be placed between the walls to be effectively shielded. At least one intermediate wall extends upwardly from the bottom wall and interconnects the front and rear walls to aid in finger placement.

In a preferred practice of the invention a serrated edge extends outwardly from the front wall beyond the bottom wall. The serrated edge would have multiple functions such as permitting the user to chop or dice with the edge or also to anchor the shielding device by having the edge dig into the item being cut.

In a further preferred practice of the invention side walls extend from the front wall to further shield the fingers. In addition, the result of this structure is to create a scoop form from the shield so that the shield could be used as a scoop or scraper, or dispenser of cooking ingredients.

THE DRAWINGS

DETAILED DESCRIPTION

Figure 2:
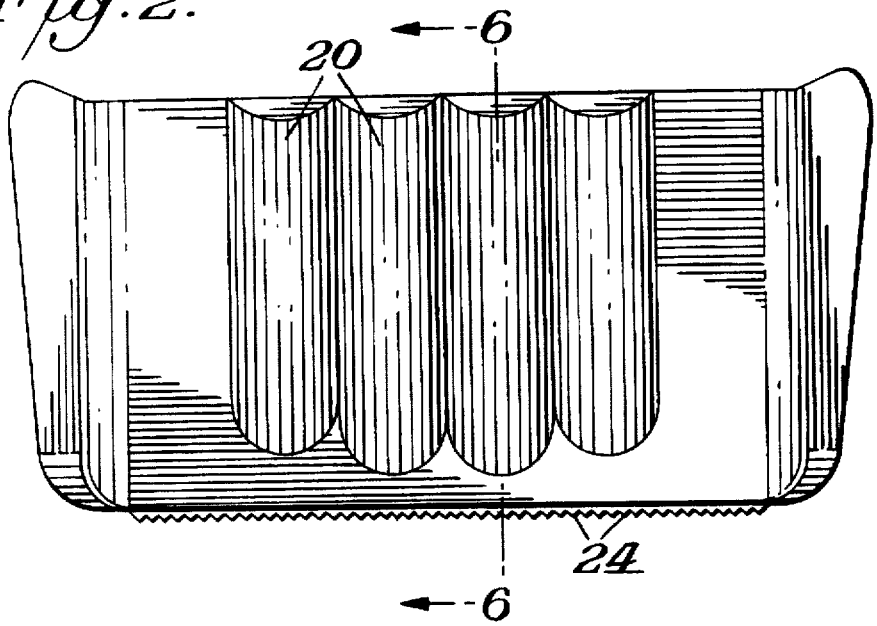
FIG. 2 is a front elevational view of the shield shown in FIG. 1.
Figure 1:
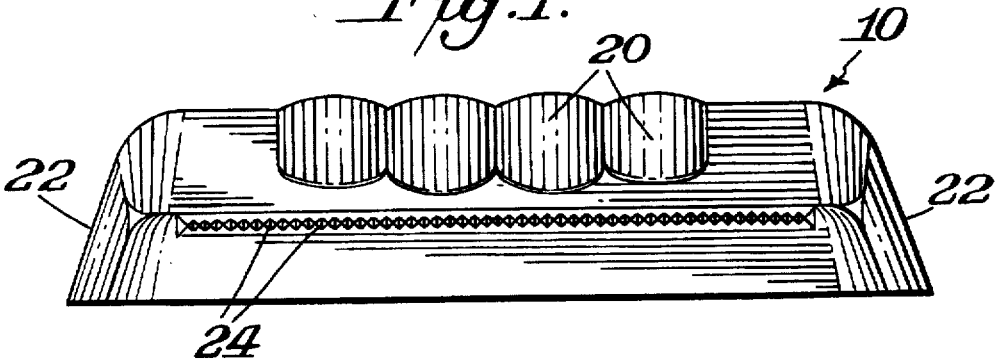
FIG. 1 is a bottom plan view of a hand and finger shield in accordance with this invention.
Figure 3:
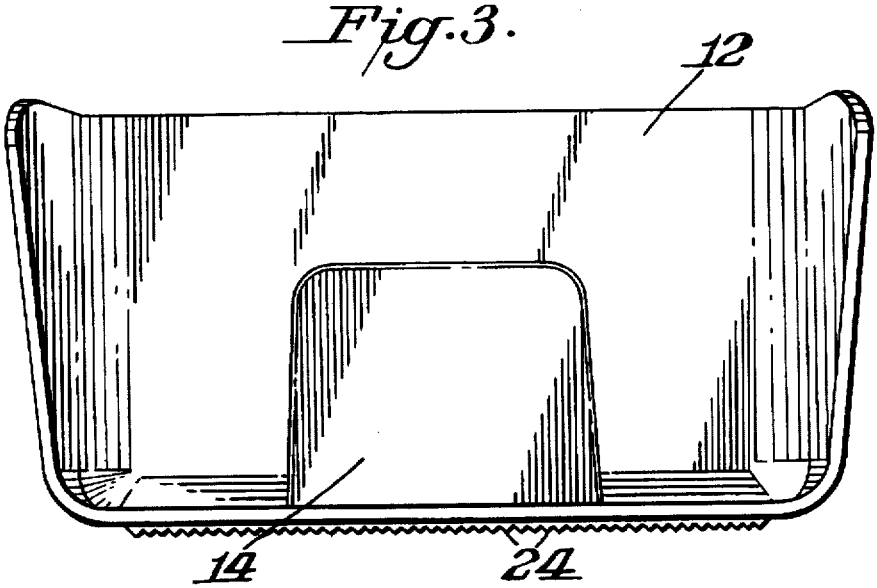
FIG. 3 is a rear elevational view of the shield shown in FIGS. 1–2.
Figure 4:
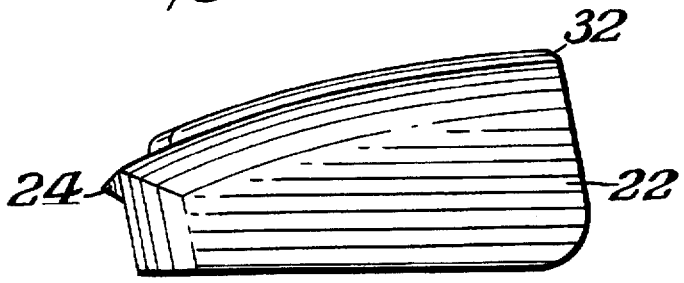
FIG. 4 is a right side elevational view of the shield shown in FIGS. 1–3 with the left side elevational view being identical.
Figure 5:
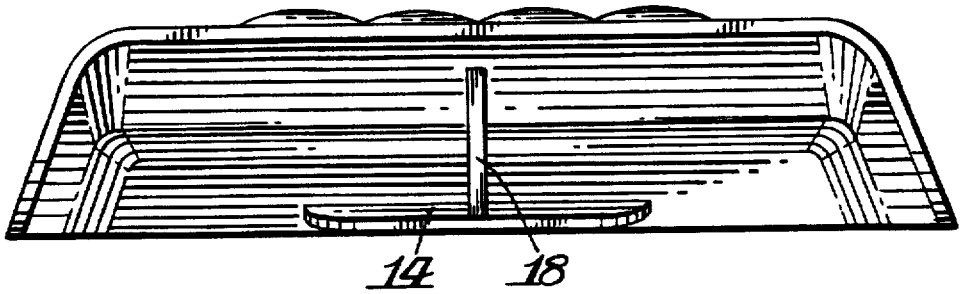
FIG. 5 is a top plan view of the shield shown in FIGS. 1–4.
Figure 6:
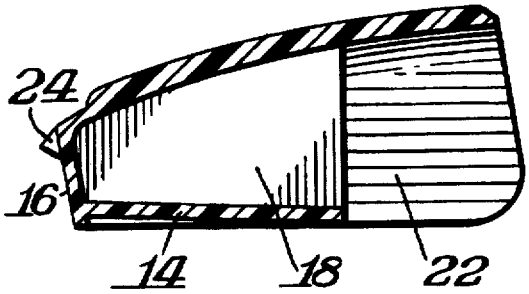
FIG. 6 is a cross-sectional view taken through FIG. 2 along the line 6—6.

FIGS. 1–6 show a hand and finger shield 10 in accordance with this invention. As shown therein the shield 10 includes a front wall 12 of sufficient length to be wider than the hand of the user. As shown in FIGS. 4 and 6 front wall 12 gently curves upwardly to generally conform to the curvature of the fingers when placed inwardly of the front wall.

Figure 10:
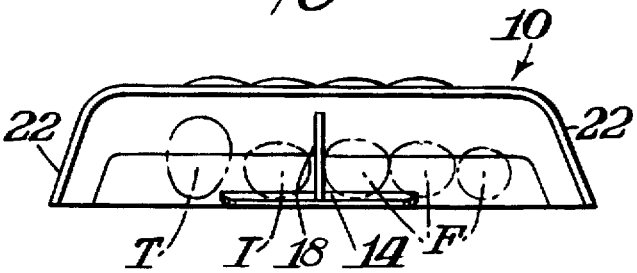
FIG. 10 is a top plan view showing the positioning of the fingers within the shield of FIGS. 1–6.

A rear wall 14 is mounted spaced from the front wall and is generally flat or planar. The front wall and rear wall are interconnected by a bottom wall 16 which may be flat and planar. At least one intermediate connecting wall 18 extends upwardly from the bottom wall 16 and interconnects front wall 12 to rear wall 14. As is apparent from FIGS. 3 and 4 rear wall 14 need not be of the same length as front wall 12 since the primary purpose of rear wall 14 is to provide an abutment against which the fingers may be placed during use of shield 10. Thus it is sufficient that rear wall 14 be of a length whereby at least two and preferably more of the fingers may be placed. FIG. 10, for example, shows the index finger I placed on one side of connecting wall 18 with the remaining fingers F on the other side and with the thumb T positioned on the same side of connecting wall 18 as the index finger I. Shield 10 may, however, be used in other manners such as by placing the index and middle fingers on one side of connecting wall 18 and the ring and small fingers on the other side or in any manner most comfortable to the user. Advantageously, the same shield may be used with either the right hand or the left hand. It is necessary to have only a single interconnecting wall since this provides sufficient stability for the connection of the front wall and rear wall while affording a high degree of flexibility to the user in deciding where the fingers should be placed. In addition it affords ample storage space for food to be scooped and later dispensed in cooking utensils, i.e. pots, pans or bowls. Shield 10 is particularly useful with such food items as cut garlic or onions which are sometimes difficult to handle.

The outer surface of front wall 12 includes simulated fingers 20 which not only adds to the aestheticness of shield 10 but also serves as a guide for finger location where shield 10 would be used with two fingers on each side of the central interconnecting wall 18.

As is apparent from FIGS. 3 and 6 rear wall 14 does not extend vertically to the same height as front wall 12. Preferably front wall 12 is of a height which would be at least the height of the second joint of the fingers so that when the hand is bent in a normal position with the finger tips against the bottom wall 16, the first and second joints are completely shielded. By having the rear wall 14 of a lower height the hand may be readily bent downwardly across the upper edge of rear wall 14.

As shown in the various figures the front wall 12 flares outwardly to create a pair of side walls 22, thereby forming a continuous unbroken wall which would shield the fingers along three sides. As later described the provision of side walls 22 results in the shield 10 taking the form of a scoop. Additionally, the outer edges of the side walls 22 may function as a scraper.

A particularly advantageous feature of this invention is the provision of a serrated extension 24 downwardly from front wall 12 beyond bottom wall 16. The serrated extension or edge 24 permits shield 10 to be used for chopping or dicing and also permits the shield to dig into or be anchored to an object being cut.

Figure 11:
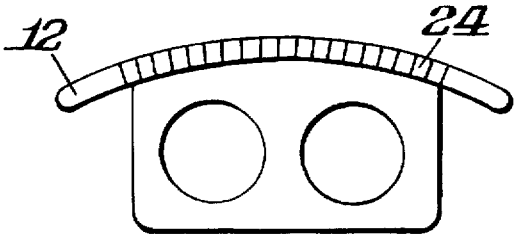
FIG. 11 is a bottom plan view of a modified form of shield in accordance with this invention.

In the preferred practice of the invention front wall 12 is curved upwardly but is generally planar when viewed from the top. See FIG. 1. If desired, however, front wall 12 may also be curved along a gentle arc when viewed from the top to more closely conform to the curvature of the hand when the fingers are placed into shield 10, as shown in FIG. 11. The planar form is preferred in that it does not restrict specific finger placement location. Thus, with a planar form one or two or three fingers may be placed on one side of the connecting wall 18 whereas the curved form would tend more to require only one manner of placement of the fingers in the shield.

As shown in FIG. 3 rear wall 14 is of a length which is about one-third of the length of front wall 12 thus creating an open area on each side of rear wall 14 of generally the same length as the rear wall itself. As also shown in FIG. 3 rear wall 14 is of a height which is about two-thirds the height of front wall 12.

Figure 7:
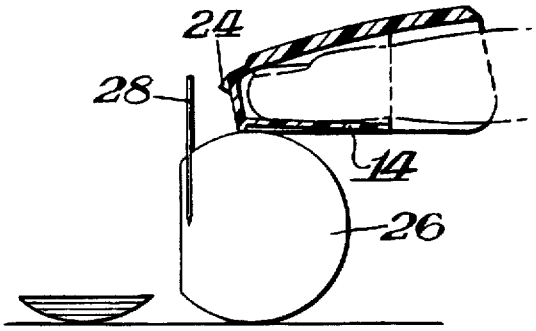
FIG. 7 is a cross-sectional view showing one use of the shield shown in FIGS. 1–6.
Figure 8:
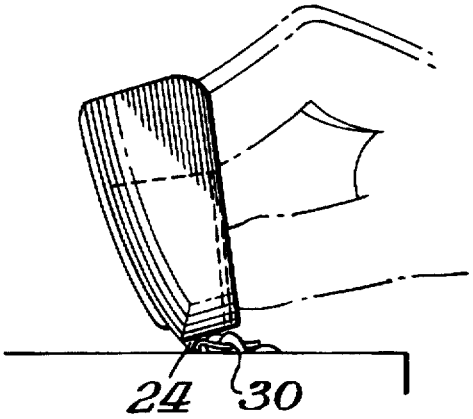
FIG. 8 is a side elevational view showing a further use of the shield shown in FIGS. 1–6.
Figure 9:
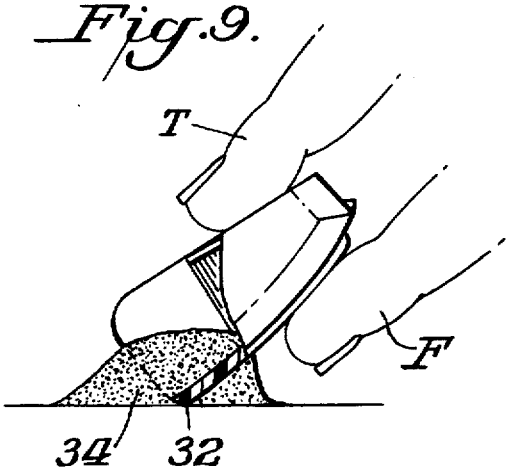
FIG. 9 is a side elevational view partially broken away and in section showing yet another use of the shield shown in FIGS. 1–6.

FIGS. 7–9 illustrate various uses of shield 10. As shown in FIG. 7, for example, shield 10 is placed with the bottom wall at its rear edge being placed on a food item 26 to hold the food item stationary while the food item is being sliced by blade 28. Alternatively, the user might place the shield in an upright position so that the serrated edge 24 digs into the food item to assure no slippage in holding the food item in place.

FIG. 8 shows use of the shield 10 to chop or dice food 30 by utilizing the serrated edge 24 as the chopping or dicing tool.

FIG. 9 shows use of shield 10 as a scoop. As shown therein shield 10 is inverted and is held with the thumb T on the outer side of rear wall 14 and the remaining fingers F on the front side of front wall 12. The upper edge 32 of front wall 12 and, if desired, side walls 22 may be tapered to facilitate scooping material 34. The upper edge 32 of the front wall and/or side walls may also be used as a scraper.

Preferably, shield 10 is made from a one piece molded material from any suitable firm rigid plastic. Alternatively, the shield may be made of stainless steel, particularly for professional or industrial uses. If desired, however, shield 10 may be manufactured or molded from more than one piece and secured together in any suitable manner. In general use, the four fingers would be placed between the front and rear walls with the thumb tucked behind the index and middle fingers.

If desired, shield 10 could be made in various colors or could be of a plain or even transparent material and could have a decorative exterior design coloration.

The invention may be practiced with various modifications. For example, an elastic band may be provided on the inside of shield 10 between the front wall and rear wall to further hold the fingers securely within the shield. Similarly, a plastic loop or ring could be provided for one or more fingers. A wall generally parallel to but spaced from the bottom wall may be provided with holes or slots for finger placement, as shown in FIG. 11.

As can be appreciated shield 10 functions as an effective utensil for use in the preparation of food items. Shield 10, however, may be used for any purpose where it is desired to protect the hand and fingers, particularly where a sharp cutting instrument is being used. As previously described shield 10 provides a protective guide that may feed, align, direct and control food products or materials without suffering any injury to the hands or fingers of the user. The structure of shield 10 is such that it may also function as a hand scoop or sweep (scraper) for removing foods or other materials. Shield 10 is thus useful not only in connection with food products but also lends itself to use in an industrial environment where it is desired to protect workers who are in contact with knives or other sharp cutting instruments or machines, particularly vertically moving instruments. A particular advantage of shield 10 is its great time saving factor.

What is claimed is:

1. A hand and finger shield comprising a front protective wall, a bottom protective wall mounted to said front protective wall, a rear wall mounted to said bottom wall and spaced from said front protective wall, at least one interconnecting wall mounted to said bottom wall and to each of said front protective wall and said rear wall for stabilizing the connection of said walls to each other and for functioning as a finger guide to aid in the placement of the fingers of a user's hand between said front protective wall and said rear wall whereby the user's fingers are shielded when placed between said walls, and a pair of side walls extending inwardly from said front wall and upwardly from said bottom wall to create a scoop structure for said shield whereby aid shield may be selectively used as a scoop and as a scraper in addition to functioning as a shield.

2. The device of claim 1 including a serrated edge extending downwardly from said front wall below said bottom wall to function as a chopping and dicing and digging instrument.

3. The shield of claim 2 wherein said front wall terminates in a tapered upper edge to facilitate said shield functioning as a scoop and as a scrapper.

4. The shield of claim 3 wherein said shield is made of one piece molded rigid plastic.

5. The shield of claim 4 wherein said front wall is of greater height than said rear wall and said intermediate wall, and said front wall being of greater width than said rear wall to provide an open area on each side of said rear wall between said rear wall and said side walls.

6. The shield of claim 5 wherein said front wall curves upwardly along an arc to simulate the curvature of the fingers, and said side walls flare outwardly from said front wall.

7. The shield of claim 6 wherein said open spaces on each side of said rear wall are of a length generally equal to the length of said rear wall.

8. The shield of claim 7 wherein said rear wall has a height which is about two-thirds the height of said front wall.

9. The shield of claim 8 including simulated fingers molded on the front surface of said front wall to function as a guide for the placement of the fingers within said shield.

10. The shield of claim 1 wherein said front wall terminates in a tapered upper edge to facilitate said shield functioning as a scoop and as a scrapper.

11. The shield of claim 10 wherein said front wall is of greater height than said rear wall and said intermediate wall, said front wall being of greater width than said rear wall to provide an open area on each side of said rear wall between said rear wall and said side walls, said front wall curving upwardly along an arc to simulate the curvature of the fingers, and said side walls flaring outwardly from said front wall.

12. A hand and finger shield comprising a rigid front protective wall, a rigid bottom protective wall mounted to said front protective wall, a rigid rear wall mounted to said bottom wall and spaced from said front protective wall, said rear wall having opposite side edges, at least one rigid interconnecting wall mounted to said bottom wall and to each of said front protective wall and said rear wall for stabilizing the connection of said walls to each other, said interconnecting wall being mounted to said rear wall at a location between said opposite side edges of said rear wall for functioning as a finger guide to aid in the placement of the fingers of a user's hand between said front protective wall and said rear wall whereby the user's fingers are shielded when placed between said walls, and a rigid serrated edge extending downwardly from said front wall below said bottom wall to function as a chopping and dicing and digging instrument.

13. A hand and finger shield comprising a rigid front protective wall having a top edge and a bottom edge and two side edges with a central portion therebetween, said central portion having a front surface and a rear surface, a rigid finger accommodating unit mounted to and extending outwardly from said rear surface, said finger accommodating unit having a central member for separating two fingers of a user, said side edges being disposed rearwardly of said central portion, rigid serrations on said bottom edge extending downwardly from said central portion in a direction away from said upper edge, said serrations being within the longitudinal confines of said central portion, and said central portion being free of serrations.

14. The shield of claim 13 wherein said finger accommodating unit includes a finger placement wall mounted to said front protective wall, said finger placement wall being generally parallel to and spaced from said bottom of said front protective wall, a plurality of finger placement holes in said finger placement wall separated from each other by a portion of said finger placement wall, and said portion of said finger placement wall separating said finger placement holes being said central member.

15. The shield of claim 14 wherein said front protective wall is curved from side edge to side edge.

16. The shield of claim 15 wherein said front protective wall is transparent.

17. The shield of claim 13 wherein said finger accommodating unit includes a rear wall spaced from said front protective wall, said rear wall having opposite side edges, and said central member being an interconnecting wall extending from said front protective wall and mounted to said rear wall at a location between said opposite side edges of said rear wall.

* * * * *